US009701384B1

(12) United States Patent
Belter

(10) Patent No.: US 9,701,384 B1
(45) Date of Patent: Jul. 11, 2017

(54) OUTBOARD MARINE ENGINES AND METHODS OF REMOVING COOLING WATER FROM OUTBOARD MARINE ENGINES

(71) Applicant: Brunswick Corporation, Lake Forest, IL (US)

(72) Inventor: David J. Belter, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/140,628

(22) Filed: Apr. 28, 2016

(51) Int. Cl.
*B63H 20/28* (2006.01)
*B63H 20/10* (2006.01)

(52) U.S. Cl.
CPC ..... *B63H 20/28* (2013.01); *B63H 20/10* (2013.01)

(58) Field of Classification Search
CPC ... F01P 3/20; F01P 3/202; F01P 11/02; B63H 5/12; B63H 21/10; B63H 21/14; B63H 20/28; B63H 21/30; B63H 21/38
USPC ..... 440/53, 88 C, 88 L, 88 P, 88 R
See application file for complete search history.

(56) References Cited

U.S. PATENT DOCUMENTS

| | | | | |
|---|---|---|---|---|
| 2,604,867 | A | 7/1952 | Frye | |
| 2,627,242 | A | 2/1953 | Kiekhaefer | |
| 4,403,972 | A | 9/1983 | Bland et al. | |
| 8,133,087 | B1 * | 3/2012 | Abou Zeid ..... | B63H 20/28 440/88 C |

* cited by examiner

*Primary Examiner* — Lars A Olson
(74) *Attorney, Agent, or Firm* — Andrus Intellectual Property Law, LLP

(57) ABSTRACT

An outboard marine engine comprises an internal combustion engine, a cooling water circuit that supplies cooling water for cooling at least one component of the outboard marine engine, and a syphon conduit connected to the cooling water circuit and configured to syphon the cooling water from the cooling water circuit when the outboard marine engine is not operating.

14 Claims, 5 Drawing Sheets

OUTBOARD MARINE ENGINES AND METHODS OF REMOVING COOLING WATER FROM OUTBOARD MARINE ENGINES

FIELD

The present disclosure relates to outboard marine engines and particularly to systems and methods for removing cooling water from outboard marine engines.

BACKGROUND

The following U.S. Patents are incorporated herein by reference in entirety:

U.S. Pat. No. 2,627,242 discloses an outboard motor adapted to be secured to the transom of a boat. The outboard motor has an engine, a housing supporting the engine, a propeller carried by the housing, an exhaust chamber in the housing to receive exhaust gases directly from the engine, and an underwater exhaust opening positioned rearwardly of the adjacent propeller. The chamber in normal operation of the engine is subject to substantially less than atmospheric pressure. A conduit having one end open at the bottom of the boat communicates with the chamber. The conduit is adapted to extend and permit the motor to be freely pivoted for steering and raising from the water.

U.S. Pat. No. 4,403,972 discloses a marine propulsion device that includes a housing surrounding an engine and including a sump which may collect water. A siphon conduit is provided for removing water from the sump, the siphon conduit including an inlet end housed in the sump and a discharge end projecting from the housing for discharging water from the sump. Another conduit is connected to the siphon conduit and for generating water flow through the siphon conduit from the sump and toward the siphon conduit discharge end, this second conduit being connected to the engine water pump and adapted to force a jet of water into the siphon conduit and toward the discharge end of the siphon conduit.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, an outboard marine engine comprises an internal combustion engine, a cooling water circuit that supplies cooling water for cooling at least one component of the outboard marine engine, and a syphon conduit connected to the cooling water circuit and configured to syphon the cooling water from the cooling water circuit when the outboard marine engine is not operating.

In certain examples, a method of draining cooling water from an outboard marine engine comprises: connecting a syphon conduit to a cooling water circuit for cooling a component of the outboard marine engine and configuring the syphon conduit such that when the outboard marine engine is trimmed up about a trim axis, the syphon conduit first drains the cooling water from the cooling water circuit by gravity and then removes the cooling water from the cooling water circuit via a syphon force.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
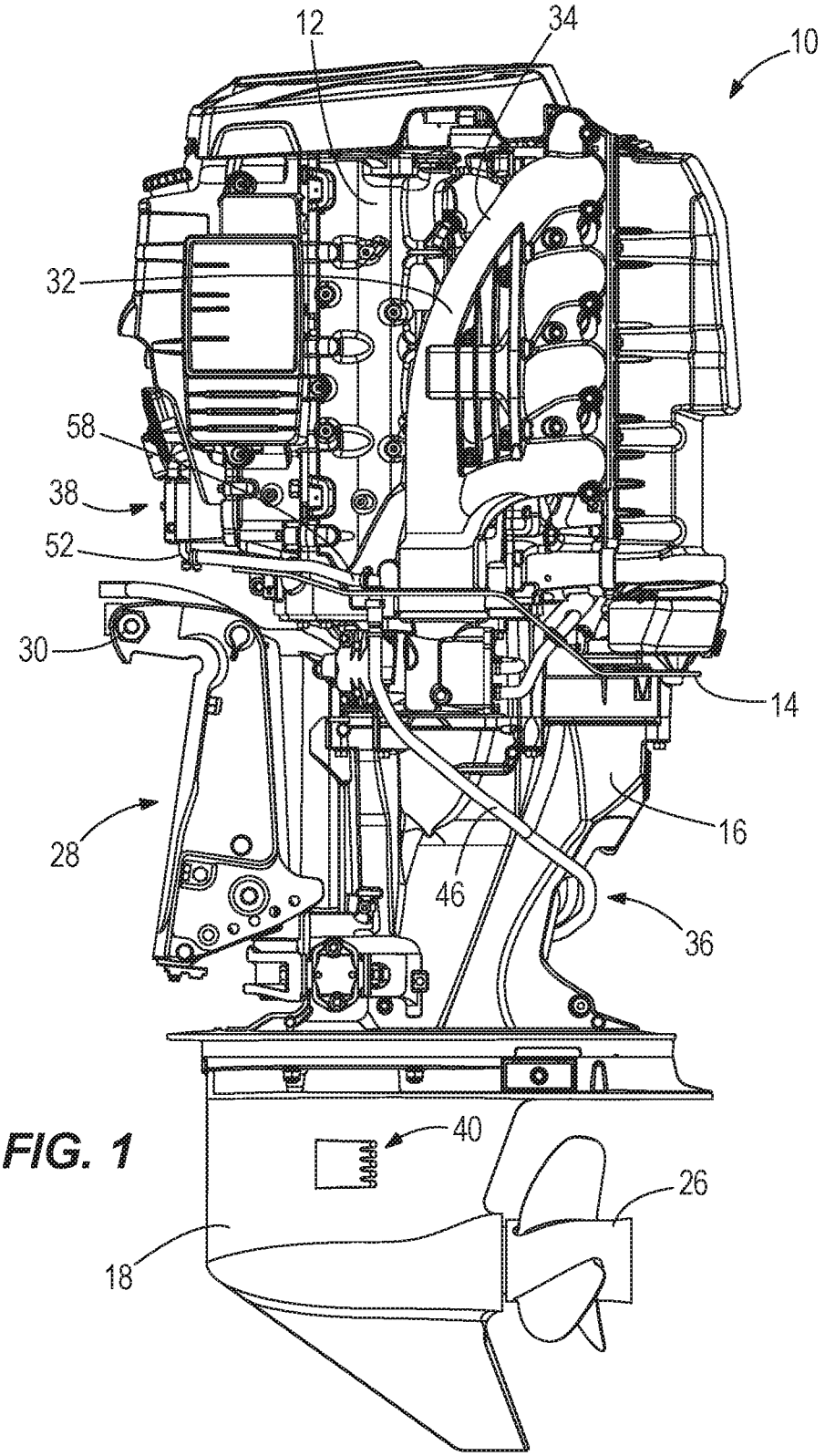
FIG. 1 is a side view of an outboard marine engine having a syphon conduit according to the present disclosure.
Figure 3:
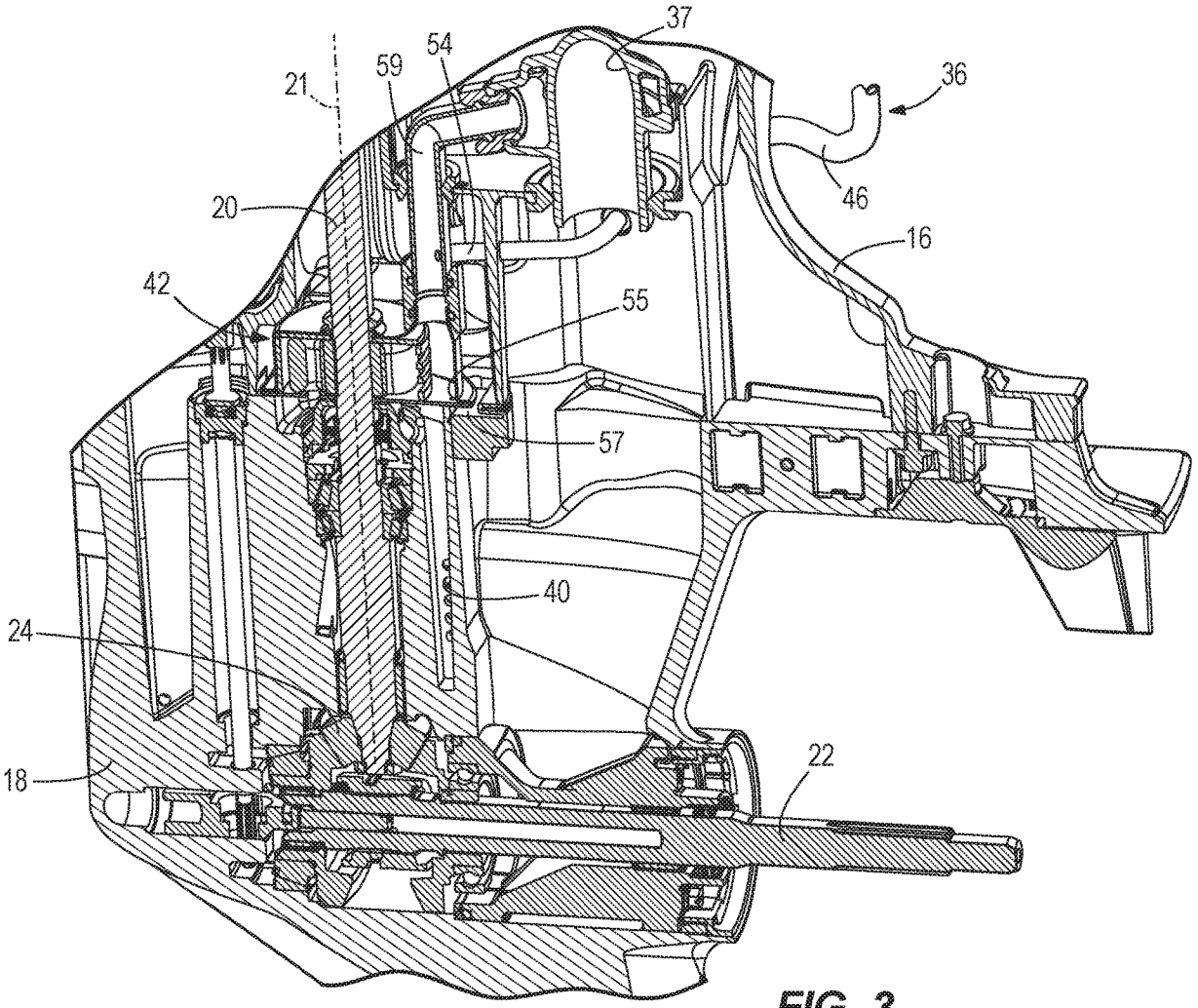
FIG. 3 is a sectional view of a gearcase on the outboard marine engine shown in FIG. 1.

FIG. 1 depicts an exemplary outboard marine engine 10 that generally includes an internal combustion engine 12 supported on an adapter plate 14. The outboard marine engine 10 further includes a driveshaft housing 16 and a lower gearcase housing 18 that extend below the adapter plate 14. As is conventional, operation of the internal combustion engine 12 causes a driveshaft 20 (FIG. 3) to rotate about its own axis 21. Rotation of the driveshaft 20 is transmitted to a propeller shaft 22, in part via bevel gears 24 disposed in the lower gearcase housing 18. Rotation of the propeller shaft 22 about its own axis causes corresponding rotation of one or more propellers 26 on the propeller shaft 22, which thereby creates thrust for driving a marine vessel to which the outboard marine engine 10 is attached. The type and configuration of the outboard marine engine 10 is merely exemplary and can vary significantly from that which is shown in the drawings and described herein.

Figure 4:
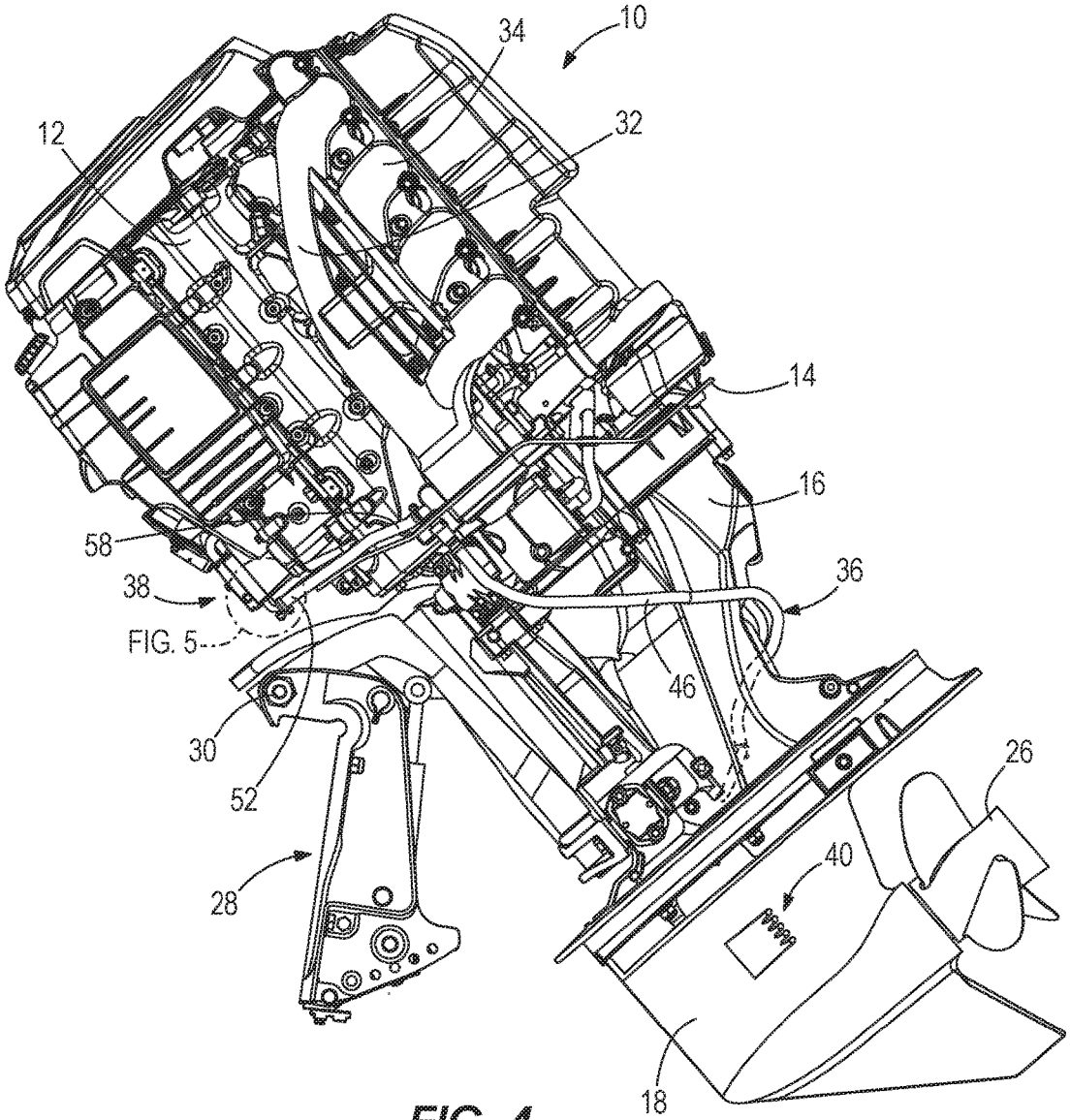
FIG. 4 is a side view of the outboard marine engine in a trimmed up position.

In the exemplary embodiment, the outboard marine engine 10 is configured for connection to a not-shown marine vessel by a conventional transom bracket arrangement 28. The transom bracket arrangement 28 is configured such that the outboard marine engine 10 is trimmable up and down with respect to the marine vessel about a trim axis 30. FIG. 1 depicts the outboard marine engine 10 in a trimmed down position and FIG. 4 depicts the outboard marine engine 10 in a trimmed up position. Trimming of the outboard marine engine 10 via the transom bracket arrangement 28 can be actuated by any conventional trim actuation mechanism, for example an electric motor arrangement and/or a hydraulic piston-cylinder arrangement.

As is conventional, exhaust gas is discharged from the internal combustion engine 12 via an exhaust manifold 32 having a plurality of exhaust runners 34. The exhaust manifold 32 conveys the exhaust gas to an exhaust tube 37 (FIG. 3), which then discharges the exhaust gas to the driveshaft housing 16 and/or the lower gearcase housing 18, all as is conventional. The exhaust gas typically is discharged through the lower gearcase housing 18 and more specifically through the propeller 26.

Figure 2:
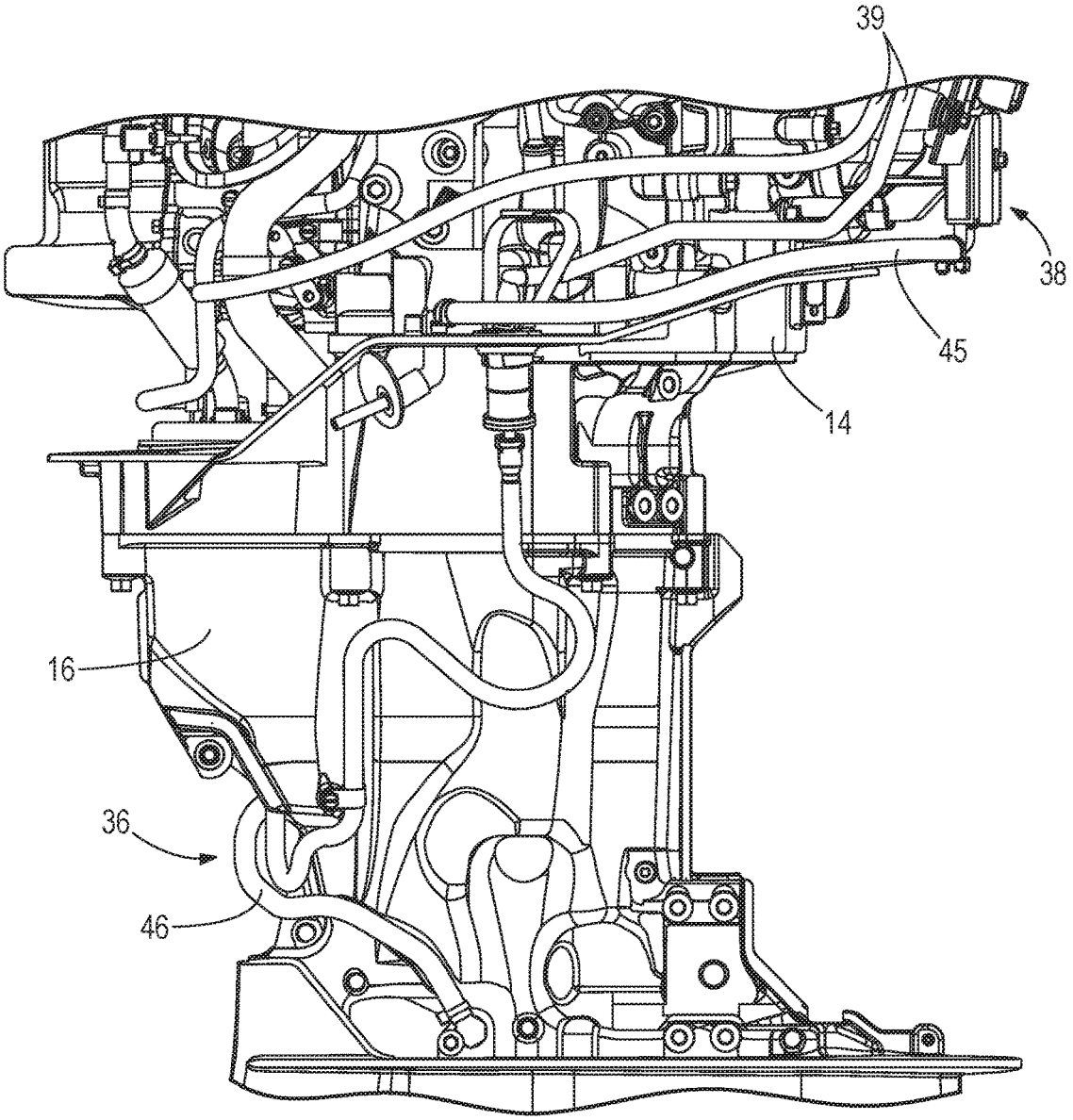
FIG. 2 is a view of a portion of FIG. 1.
Figure 5:
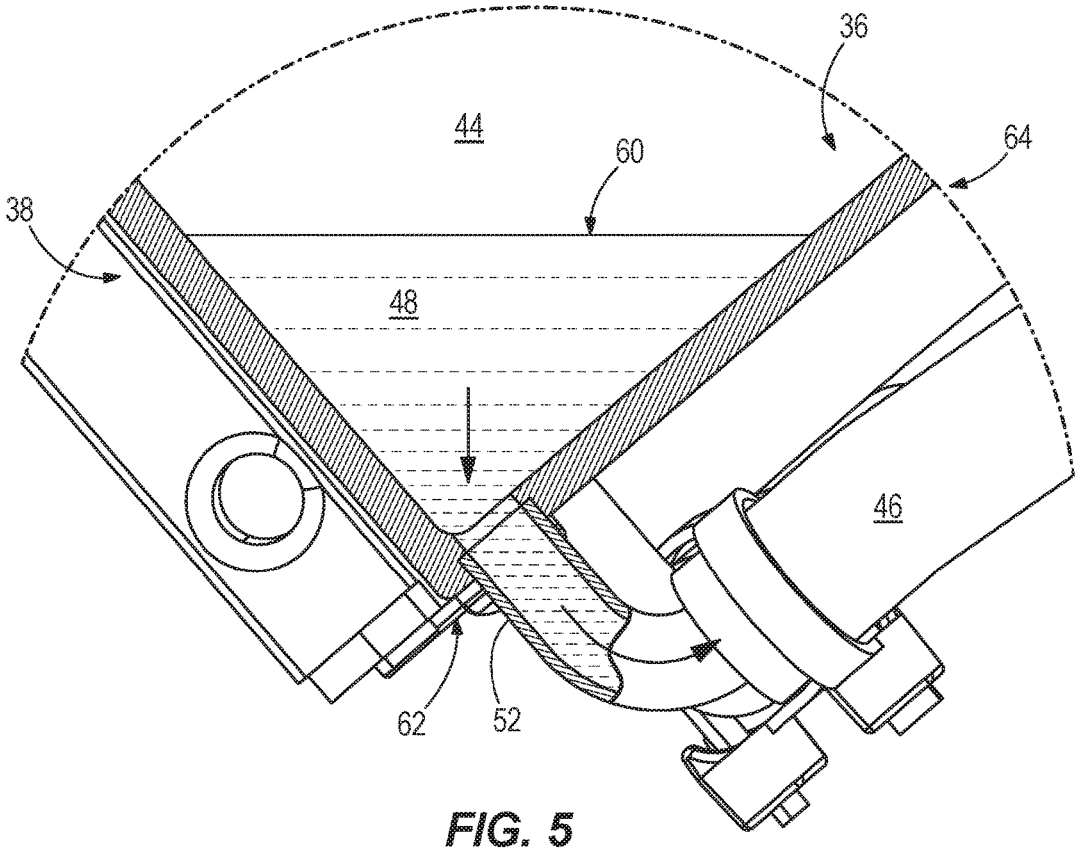
FIG. 5 is a detail view of a portion of FIG. 4.

The outboard marine engine 10 is equipped with a cooling water circuit (referred to generally at 36) that conveys raw cooling water from the body of the water in which the outboard marine engine 10 is operating to thereby cool one or more relatively warm components associated with the internal combustion engine 12. The particular configuration of the cooling water circuit 36 can vary. In the example shown in FIGS. 1-5, the cooling water circuit 36 includes cooling passages 44 (FIG. 5) in a fuel cooler 38 (FIG. 1, for example). The cooling passages 44 are configured to cause an exchange of heat between the relatively cool cooling water and the relatively warm fuel associated with the combustion process in the internal combustion engine 12. It should be recognized however that the fuel cooler 38 is just one example of a type of component of the outboard marine engine 10 that may be cooled by the cooling water circuit 36. Other examples can include oil coolers, supercharger coolers, different types of fuel coolers, and/or the like. In the illustrated example, a conventional impeller-type cooling water pump 42 (FIG. 3) draws the cooling water into the cooling water circuit 36 at an upstream inlet 40. The cooling water pump 42 is configured to pump the cooling water upwardly to the noted cooling passages 44 in the fuel cooler 38 via a syphon conduit 46, which forms part of the noted cooling water circuit 36 and is a subject of the present disclosure that will be further described herein below. The fuel cooler 38 receives and discharges fuel via for example fuel lines 39. As is conventional, the cooling passage 44 and not-shown noted fuel passages in the fuel cooler 38 are positioned adjacent to each other such that the relatively cool cooling water exchanges heat with the relatively hot fuel, thereby cooling the fuel. During operation of the outboard marine engine 10, spent cooling water is discharged from the cooling passage 44 and back to the body of water in which the outboard marine engine 10 is operating via for example one or more discharge conduits 45 (FIG. 2).

During research and experimentation, the present inventor has determined that it is desirable but can be difficult to remove all of the cooling water from the outboard marine engine once the outboard marine engine is turned off and trimmed up and/or prepared for storage. Most portions of the cooling water circuits of the outboard marine engine will drain by gravity when the internal combustion engine 12 is turned off and the outboard marine engine remains positioned in the trimmed down position shown in FIG. 1. However, when the outboard marine engine is trimmed up, such as shown in FIG. 4, certain areas of the cooling water circuit are oriented so that the cooling water does not drain by gravity. This can mainly occur at the forward ends of the cooling water passages, i.e. the ends located closer to the transom bracket and transom of the marine vessel. These areas effectively form isolated "low areas" from which cooling water does not drain once the outboard marine engine is trimmed up. This can be due to the connection location of the cooling circuit conduits at the cooling water passages and/or the orientation of the noted component(s) with respect to gravity. Cooling water that resides in these "low areas" of an out-of-service outboard marine engine can freeze and thaw when the outside temperature changes, thus undesirably causing freeze damage to the noted components.

According to the present disclosure, systems and methods are provided for actively removing cooling water from the noted "low areas" when gravity draining is ineffective. According to the present disclosure, the cooling water circuit 36 is provided with a syphon conduit 46 that is configured to syphon the cooling water from the cooling water circuit 36 when the outboard marine engine 10 is not operating and gravity draining is no longer effective, for example at the noted "low areas" when the outboard marine engine 10 is in the trimmed up position shown in FIG. 4.

As described herein above, during operation of the internal combustion engine 12, raw cooling water is pumped to the cooling passage 44 in the fuel cooler 38 via the syphon conduit 46. When the outboard marine engine 10 is turned off and stored in the trimmed-up position shown in FIG. 4, the syphon conduit 46 is configured such that the cooling water 48 in the cooling passages 44 (FIG. 5) first drains by gravity back though the syphon conduit 46 to a discharge passage or outlet connected to a cavity in the lower gearcase housing 18. Specifically, the syphon conduit 46 drains cooling water to a water tube 59, which subsequently drains to a drain passage 57 via a drain hole 55 near the cooling water pump 42. The drain passage 57 feeds to the noted discharge passage or outlet connected to the cavity in the lower gearcase housing 18. The syphon conduit 46 has a first end 52 (FIG. 1) that is connected to the fuel cooler 38 and an opposite, second end 54 (FIG. 3) that is configured to discharge the cooling water 48 to the discharge passage or outlet, when the engine is not operating. The first end 52 is located vertically higher than the opposite, second end 54. Thus, once the cooling water 48 in the cooling passages 44 drains to the vertical height of an intermediate portion 58 of the syphon conduit 46, located between the first and second ends 52, 54, the outflow of cooling water that is being drained by gravity causes a syphon force that takes over and syphons the remaining or most of the remaining cooling water 48 from the low area of the cooling passages 44 located forwardly of the first end 52. In other words, the syphon conduit 46 is configured such that the cooling water first drains from the cooling water circuit 36 by gravity until a top surface 60 of the cooling water 48 in the cooling passages 44 is vertically level with an intermediate portion 58 of the syphon conduit 46. Thereafter, the cooling water 48 is automatically removed from the cooling passages via the syphon force.

The concepts of the present disclosure can be particularly useful for removing cooling water from a component of the outboard marine engine 10 that is located forwardly of the driveshaft 20, though this is not required. Examples of such components are mentioned herein above, including oil coolers, supercharger coolers, different types of fuel coolers, and/or the like.

Therefore according to the present disclosure, an outboard marine engine 10 includes an internal combustion engine 12, a cooling water circuit 36 that supplies cooling water 48 for cooling the component (fuel cooler 38) of the outboard marine engine 10, and a syphon conduit 46 connected to the cooling water circuit 36 and configured to syphon the cooling water 48 from the cooling water circuit 36 when the outboard marine engine 10 is not operating. Once the internal combustion engine 12 and associated cooling water pump 42 is turned off, the syphon conduit 46 is configured to automatically drain the cooling water 48 from the cooling water circuit 36 by gravity and thereafter remove the cooling water 48 from the cooling water circuit 36 via a syphon force. The outboard marine engine 10 has a driveshaft 20 that is driven into rotation by the internal combustion engine 12. The driveshaft 20 extends along a driveshaft axis. The outboard marine engine 10 is trimmable up into a position in which the driveshaft axis is set at an angle to vertical. The syphon conduit 46 first drains the cooling water 48 from the cooling water circuit 36 by gravity and thereafter removes the cooling water 48 from the cooling water circuit 36 via the syphon force.

The syphon conduit 46 has a first end 52 connected to the component (fuel cooler 38) of the outboard marine engine and an opposite, second end 54 configured to drain cooling water 48 from the outboard marine engine 10. The first end 52 is located vertically higher than the opposite, second end 54 regardless of whether the outboard marine engine 10 is trimmed up or down. The syphon conduit 46 has an intermediate portion 58 that is located between the first end 52 and the opposite, second end 54. The syphon conduit 46 is configured to drain the cooling water 48 from the cooling water circuit 36 by gravity until a top surface 60 of the cooling water 48 in the cooling water circuit 36 is vertically level with the intermediate portion 58, after which the syphon conduit 46 removes the cooling water 48 from the cooling water circuit 36 via the syphon force.

The outboard marine engine 10 is configured to be trimmed up and down about a trim axis 30 that extends perpendicularly with respect to the driveshaft axis. The component (in this example, the fuel cooler 38) of the outboard marine engine 10 is located forwardly of the driveshaft axis, as shown in FIG. 1. When the outboard marine engine 10 is trimmed up about the trim axis 30, the intermediate portion 58 of the syphon conduit 46 is located vertically higher than the first end 52 and thus the syphon force syphons the cooling water 48 upwardly from the first end 52 through the intermediate portion 58 and then downwardly to the opposite, second end 54.

In the illustrated example, the syphon conduit 46 passes through the adapter plate 14, which is configured to support the internal combustion engine 12. The cooling water pump 42 is configured to pump the cooling water 48 through the cooling water circuit 36 to the component (fuel cooler 38) via the syphon conduit 46. A discharge passage or outlet 56 allows the cooling water 48 to pass out of the syphon conduit 46, past the cooling water pump 42, when the outboard marine engine 10 is not operating. The component (fuel cooler 38) of the outboard marine engine 10 has a forward end 62 and an opposite, aftward end 64. The first end 52 of the syphon conduit 46 is coupled to the component (fuel cooler 38) closer to the forward end 62 than the opposite, aftward end 64 so that when the outboard marine engine 10 is trimmed up, all or nearly all of the cooling water 48 is removed from the cooling water circuit 36 by the syphon conduit 46. In the illustrated example, the component includes a fuel cooler 38.

The present disclosure thus also provides methods of draining cooling water from an outboard marine engine including connecting a syphon conduit to a cooling water circuit for cooling a component of the outboard marine engine, configuring the syphon conduit such that when the outboard marine engine is trimmed up about a trim axis, the syphon conduit first drains the cooling water from the cooling water circuit by gravity and then removes the cooling water from the cooling water circuit via a syphon force. In this configuration, trimming of the outboard marine engine up about the trim axis causes the syphon conduit to first drain and thereafter remove via a syphon force.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. An outboard marine engine comprising an internal combustion engine; a cooling water circuit that supplies cooling water for cooling at least one component of the outboard marine engine; a syphon conduit connected to the cooling water circuit and configured to syphon the cooling water from the cooling water circuit when the outboard marine engine is not operating, wherein the syphon conduit is coupled to the at least one component and configured so that when the outboard marine engine is trimmed up, all or nearly all of the cooling water is removed from the cooling water circuit by the syphon conduit, and wherein the syphon conduit is configured to first drain the cooling water from the cooling water circuit by gravity and thereafter remove the cooling water from the cooling water circuit via a syphon force; and a driveshaft that is driven into rotation by the internal combustion engine, wherein the driveshaft extends along a driveshaft axis, and wherein when the outboard marine engine is trimmed up into a position in which the driveshaft axis is set at an angle to vertical, the syphon conduit first drains the cooling water from the cooling water circuit by gravity and then removes the cooling water from the cooling water circuit via the syphon force.

2. The outboard marine engine according to claim 1, wherein the syphon conduit has a first end connected to the at least one component of the outboard marine engine and an opposite, second end configured to discharge cooling water from the outboard marine engine.

3. The outboard marine engine according to claim 2, wherein the first end is located vertically higher than the opposite, second end regardless of whether the outboard marine engine is trimmed up or down.

4. The outboard marine engine according to claim 3, wherein the syphon conduit has an intermediate portion that is between the first end and the opposite, second end, and wherein the syphon conduit is configured to drain the cooling water from the cooling water circuit by gravity until a top surface of the cooling water in the cooling water circuit is vertically level with the intermediate portion, after which the syphon conduit removes the cooling water from the cooling water circuit via the syphon force.

5. The outboard marine engine according to claim 4, wherein the outboard marine engine is configured to be trimmed up and down about a trim axis that extends perpendicularly to the driveshaft axis, and wherein the at least one component of the outboard marine engine is located forwardly of the driveshaft axis.

6. The outboard marine engine according to claim 5, wherein when the outboard marine engine is trimmed up about the trim axis, the intermediate portion is located higher than the first end and wherein the syphon force syphons the cooling water upwardly from the first end through the intermediate portion and then downwardly to the opposite, second end.

7. The outboard marine engine according to claim 6, wherein the syphon conduit passes through an adapter plate that is configured to support the internal combustion engine.

8. The outboard marine engine according to claim 1, further comprising a cooling water pump that is configured to pump the cooling water through the cooling water circuit to the at least one component via the syphon conduit.

9. An outboard marine engine comprising an internal combustion engine; a cooling water circuit that supplies cooling water for cooling at least one component of the outboard marine engine; a syphon conduit connected to the cooling water circuit and configured to syphon the cooling water from the cooling water circuit when the outboard marine engine is not operating; a cooling water pump that is configured to pump the cooling water through the cooling water circuit to the at least one component via the syphon conduit; and a discharge outlet that allows the cooling water to pass out of the syphon conduit, past the cooling water pump, when the outboard marine engine is not operating.

10. An outboard marine engine comprising an internal combustion engine; a cooling water circuit that supplies cooling water for cooling at least one component of the outboard marine engine; and a syphon conduit connected to the cooling water circuit and configured to syphon the cooling water from the cooling water circuit when the outboard marine engine is not operating, wherein the at least one component of the outboard marine engine has a forward end and an opposite, aftward end and wherein a first end of the syphon conduit is coupled to the at least one component closer to the forward end than the opposite, aftward end so that when the outboard marine engine is trimmed up, all or nearly all of the cooling water is removed from the cooling water circuit by the syphon conduit.

11. An outboard marine engine comprising an internal combustion engine; a cooling water circuit that supplies cooling water for cooling at least one component of the outboard marine engine; and a syphon conduit connected to the cooling water circuit and configured to syphon the cooling water from the cooling water circuit when the outboard marine engine is not operating, wherein the at least one component of the outboard marine engine comprises a fuel cooler.

12. A system for removing cooling water from an outboard marine engine having an internal combustion engine, the system comprising a cooling water circuit that supplies cooling water for cooling at least one component of the outboard marine engine, and a syphon conduit connected to the cooling water circuit and configured to syphon the cooling water from the cooling water circuit when the outboard marine engine is not operating; wherein the syphon conduit is coupled to the at least one component and configured so that when the outboard marine engine is trimmed up, all or nearly all of the cooling water is removed from the cooling water circuit by the syphon conduit, wherein the syphon conduit is configured to first drain the cooling water from the cooling water circuit by gravity and thereafter remove the cooling water from the cooling water circuit via a syphon force, wherein the syphon conduit has a first end connected to the component of the outboard marine engine and an opposite, second end configured to drain cooling water from the outboard marine engine, when the engine is not operating, wherein the outboard marine engine comprises a driveshaft that is driven into rotation by the internal combustion engine, wherein the driveshaft extends along a driveshaft axis, and wherein when the outboard marine engine is trimmed up into a position in which the driveshaft axis is set at an angle to vertical, the syphon conduit is configured to first drain the cooling water from the cooling water circuit by gravity and then remove the cooling water via a syphon force.

13. The system according to claim 12, wherein the syphon conduit has an intermediate portion that is between the first end and the second end, and wherein the syphon conduit is configured to drain the cooling water from the cooling water circuit by gravity until a top surface of the cooling water in the cooling water circuit is vertically level with the intermediate portion, after which the syphon conduit removes the cooling water from the cooling water circuit via the syphon force.

14. A method of draining cooling water from an outboard marine engine, the method comprising connecting a syphon conduit to a cooling water circuit for cooling a component of the outboard marine engine; configuring the syphon conduit such that when the outboard marine engine is trimmed up about a trim axis, and the engine is not operating the syphon conduit first drains the cooling water from the cooling water circuit by gravity and then removes all or nearly all of the cooling water from the cooling water circuit via a syphon force; and then trimming the outboard marine engine up about the trim axis to thereby cause the syphon conduit to first drain the cooling water from the cooling water circuit by gravity and then remove the cooling water from the cooling water circuit via a syphon force.

* * * * *